US007608293B2

(12) United States Patent
Huang et al.

(10) Patent No.: US 7,608,293 B2
(45) Date of Patent: Oct. 27, 2009

(54) FIELD EMISSION DEVICE AND METHOD FOR MANUFACTURING SAME

(75) Inventors: Hua Huang, Beijing (CN); Yang Wei, Beijing (CN); Yang Wu, Beijing (CN); Liang Liu, Beijing (CN); Chang-Hong Liu, Beijing (CN); Shou-Shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 342 days.

(21) Appl. No.: 11/453,460

(22) Filed: Jun. 14, 2006

(65) Prior Publication Data

US 2007/0013287 A1 Jan. 18, 2007

(30) Foreign Application Priority Data

Jul. 15, 2005 (CN) ..... 2005 1 0036032

(51) Int. Cl.
*B05D 5/12* (2006.01)

(52) U.S. Cl. ..... 427/77; 427/430.1; 427/373.2

(58) Field of Classification Search ..... 427/77–78, 427/430.1–443.2, 372.2
See application file for complete search history.

(56) References Cited

U.S. PATENT DOCUMENTS

| | | | | |
|---|---|---|---|---|
| 6,250,984 | B1 * | 6/2001 | Jin et al. | 445/51 |
| 6,283,812 | B1 | 9/2001 | Jin et al. | |
| 2001/0001696 | A1 * | 5/2001 | Tai et al. | 430/26 |
| 2002/0008454 | A1 * | 1/2002 | Ishiwata et al. | 313/310 |
| 2003/0132393 | A1 * | 7/2003 | Dimitrijevic et al. | 250/423 F |
| 2004/0029382 | A1 * | 2/2004 | Kawase | 438/689 |
| 2004/0166235 | A1 * | 8/2004 | Fujii et al. | 427/77 |
| 2006/0079012 | A1 * | 4/2006 | Jeong et al. | 438/20 |

FOREIGN PATENT DOCUMENTS

| | | | |
|---|---|---|---|
| EP | 1092680 | A1 | 4/2001 |
| JP | P2004-281388 | A | 10/2004 |

* cited by examiner

*Primary Examiner*—Timothy H Meeks
*Assistant Examiner*—Jimmy Lin
(74) *Attorney, Agent, or Firm*—Clifford O. Chi

(57) ABSTRACT

A field emission device, including: a cathode substrate; a carbon nanotube array slice attached on the cathode substrate, the carbon nanotube array slice including a plurality of carbon nanotube segments arranged approximately parallel to each other, the carbon nanotube segments each having a first end and an opposite second end, the first ends thereof terminating at a common plane, and the second ends thereof being electrically connected to the cathode plant. A method for manufacturing the field emission devices based on carbon nanotube array is also provided.

8 Claims, 2 Drawing Sheets

FIELD EMISSION DEVICE AND METHOD FOR MANUFACTURING SAME

BACKGROUND

1. Technical Field

The present invention generally relates to field emission devices, and more particularly to a field emission device based on carbon nanotube array. The present invention also relates to a method for manufacturing field emission devices.

2. Discussion of Related Art

Carbon nanotubes produced by arc discharge between graphite rods were first discovered and reported in an article by Sumio Iijima entitled "Helical Microtubules of Graphitic Carbon" (Nature, Vol. 354, Nov. 7, 1991, pp. 56-58). Carbon nanotubes can transmit an extremely high electrical current and emit electrons easily at a very low voltage of less than 100 volts, which makes them a very promising potential material for field emission applications.

A conventional carbon nanotubes field emission device includes a cathode substrate and a carbon nanotubes layer formed thereon and functioning as an emitter. Field emission devices are widely used for field emission displays (FEDs), vacuum electron source and in other fields.

One conventional method for manufacturing carbon nanotubes field emission device is a screen-printing method. The screen-printing method mainly includes the steps of mixing carbon nanotubes into a paste material and then printing the paste material onto a cathode substrate. However, the surfaces of carbon nanotubes tend to be covered in the paste material and are therefore unable to combine with the cathode substrate directly, as a result it is difficult to control emittion state of carbon nanotubes using a cathode substrate. Furthermore, orientation of tips of carbon nanotubes when used as emitters is inconsistent, so it is difficult to control uniformity and stability of a carbon nanotubes field emission device.

The other conventional method for manufacturing a carbon nanotube field emission device includes the steps of: forming a metal catalyst layer on a substrate; etching the metal catalyst layer to form isolated nano-sized catalytic metal particles; growing carbon nanotubes from said isolated nano-sized catalytic metal particles using a thermal chemical vapor deposition (CVD) process; and purifying the carbon nanotubes in-situ. The carbon nanotubes formed by the above-described method are vertically aligned on the substrate. However, the above-described method is performed at a temperature in the range from 700° C. to 1000° C., thus the materials that can be used in the cathode substrate are restricted to those materials which can withstand high temperatures. Furthermore, tips of carbon nanotubes array are not formed in one plane, and the field emission can be uneven as a result. Moreover, the efficiency for utilizing carbon nanotubes is poor due to the fact that only one carbon nanotube element can be produced at a time.

What is needed, therefore, is a field emission device and a method for manufacturing the same, that can overcome the above problems.

SUMMARY

In one preferred embodiment, a field emission device, including: a cathode substrate; a carbon nanotube array slice attached to the cathode substrate, the carbon nanotube array slice including a plurality of carbon nanotube segments arranged approximately parallel to each other, the carbon nanotube segments each having a first end and an opposite second end, the first ends thereof terminating at a common plane, and the second ends thereof being electrically connected to the cathode plant.

The field emission device of the described embodiment has several advantages. A wide range of materials can be used in the construction of the cathode substrate, there is better uniformity and stability of field emission, and higher efficiency for utilizing carbon nanotubes.

In another preferred embodiment, a method for manufacturing a field emission device based on a carbon nanotube array is provided. The method includes the steps of providing a carbon nanotube array slice preform, the carbon nanotube array slice preform comprising a matrix and a plurality of carbon nanotube segments incorporated in the matrix; placing the carbon nanotube array slice preform on a cathode substrate; heating the matrix so as to change the matrix into a liquid state; removing the matrix and thereby obtaining the field emission device.

BRIEF DESCRIPTION OF THE DRAWINGS

Many aspects of the field emission device and the method for manufacturing the same can be better understood with reference to the following drawings. The components in the drawings are not necessarily drawn to scale, emphasis instead being placed upon clearly illustrating the principles of the present invention. Moreover, in the drawings, like reference numerals designate corresponding parts throughout the several views.

DETAILED DESCRIPTION OF PREFERRED EMBODIMENTS

Reference will now be made to the drawings to describe embodiments of the present field emission device and method for manufacturing the same in detail.

Figure 7:
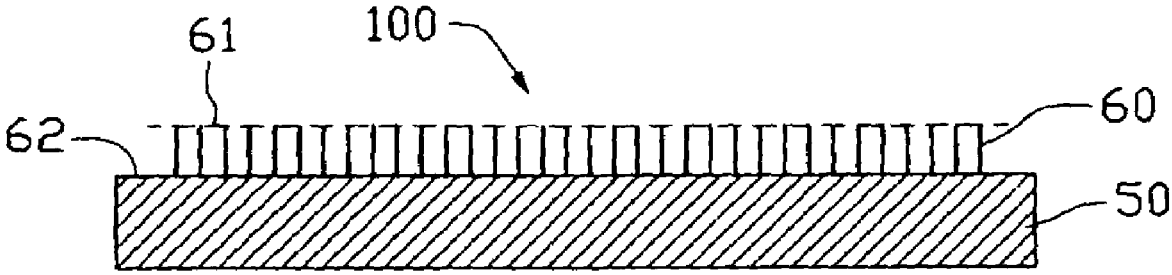
FIG. 7 is a schematic side view of a field emission device based on carbon nanotube array according to a preferred embodiment.

Referring to FIG. 7, a field emission device 100 according to a preferred embodiment is provided. The field emission device based on carbon nanotube array 100 includes a cathode substrate 50 and a carbon nanotube array slice 60.

The cathode substrate 50 can be made of silicon, aluminum or other metals. The cathode substrate 50 also can be indium tin oxide (ITO) glass or a non-conducting plate comprised of glass or plastic having an electrically conductive layer thereon where the electrically conductive layer is a silver-containing layer. In the first embodiment the cathode substrate 50 is made of silicon.

The carbon nanotube array slice 60 is manufactured by transversely slicing a carbon nanotube array, which will be described in detail later. A thickness of the carbon nanotube array slice 60 is in the range from 1 μm (micrometers) to 1000 μm. The carbon nanotube array slice 60 includes a plurality of carbon nanotube segments, the carbon nanotube segment has two ends, and the carbon nanotube segments are arranged with uniform height and are aligned approximately parallel to each other. Preferably, the arrangement of carbon nanotube segments should form a predetermined pattern, the predetermined pattern should accommodate the application yield of the field emission device 100, for example, if the field emission device is applied to field emission display, the predetermined pattern can be configured to spatially correspond to a pixel array of a field emission display. The carbon nanotube segments each have a first end and an opposite second end, each of the first ends and the second ends has an opening; the first ends thereof terminating at a common plane so as to create a first end surface 61 of the carbon nanotube array slice 60; the second ends thereof terminating at a common plane so as to create a second end surface 62 of the carbon nanotube array slice 60, the plane being approximately parallel to the cathode substrate 50. Preferably, the first end surface 61 and second end surface 62 are approximately parallel to the cathode substrate 50. The first ends act as emitters for the field emission device 100 and the second ends thereof being electrically connected to the cathode substrate 50.

Because the field emission device 100 does not use a carbon nanotube array manufactured by a CVD method but instead use the carbon nanotube array slice 60, the cathode substrate can be formed of materials other those with high-melting points, thus there is a wider range of selection of materials which can be used for the cathode substrate 50. The carbon nanotube array slice 60 has better field emission capability even if thickness of the carbon nanotube array slice is only several microns, so hundreds of carbon nanotube array slices 60 can be made by slicing the carbon nanotube array, thus enhancing production efficiency. Moreover, a plurality of carbon nanotube segments of the carbon nanotube array slice can be arranged approximately parallel to each other, and the tips as emitters are confined to one plane so as to obtain better uniformity and stability of field emission.

An exemplary method for manufacturing the field emission device based on carbon nanotube array includes the following steps in no particular order:

(1) providing a carbon nanotube array slice preform, the carbon nanotube array slice preform comprising a matrix and a plurality of carbon nanotube segments incorporated in the matrix;

(2) placing the carbon nanotube array slice preform on a cathode substrate;

(3) heating the matrix so as to change the matrix into a liquid state; and (4) removing the matrix thereby obtaining the field emission device.

Figure 1:
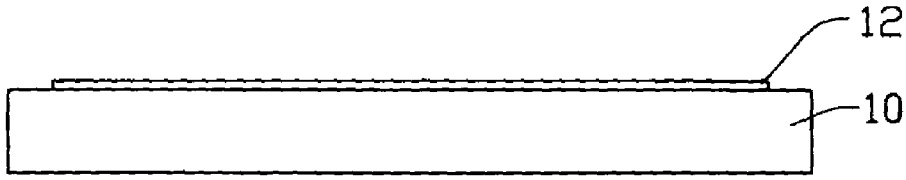
FIG. 1 is a schematic side view showing one stage of a method for manufacturing a field emission device, namely preparing a substrate having a film of catalyst thereon according to an exemplary embodiment.
Figure 2:
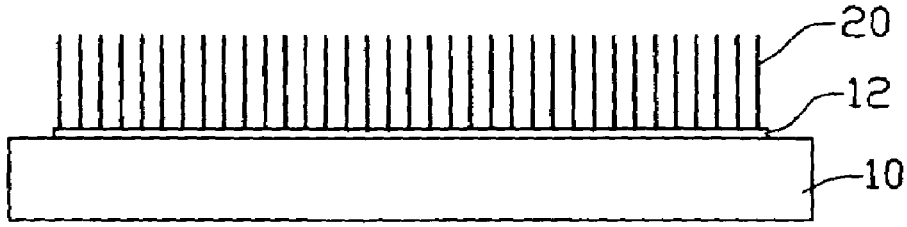
FIG. 2 is similar to FIG. 1, but showing a carbon nanotube array formed on the substrate.

In step (1), a carbon nanotube array slice preform is formed. The carbon nanotube array slice perform may be produced using the following method:

First, a carbon nanotube array is formed on the substrate. There are many methods of manufacturing a carbon nanotube array; for example, referring to FIG. 1 and FIG. 2, a film of catalyst 12 can be uniformly disposed on a substrate 10 by means of thermal deposition, electron-beam deposition or sputtering. Preferably, the film of catalyst 12 has a predetermined pattern so that the distribution of carbon nanotubes in the carbon nanotube array is the same as the predetermined pattern, the predetermined pattern can be achieved by using a patterned mask. The predetermined pattern is the same as the pattern on the cathode substrate, the predetermined pattern can be created based on application yield of the field emission device, for example, if the field emission device is applied to a field emission display, the predetermined pattern can be configured to spatially correspond to a pixel array of a field emission display.

The substrate 10 can be made of silicon, glass, quartz, or aluminum oxide. In the embodiment the substrate 10 is made of porous silicon, porous layer is configured on surface of the porous silicon; the diameter of hole of the porous layer can be less than three nanometers. The film of catalyst 12 can be made of iron (Fe), copper (Co), nickel (Ni) or any suitable alloy thereof.

Carbon nanotube array 20 can be formed by a CVD method. The film of catalyst 12 can be oxidized to obtain catalyst particles (not shown); then, the substrate 10 with the catalyst particles disposed thereon can be placed in a reaction furnace (not shown); and a carbon source gas can be provided in the reaction furnace at a temperature in range from 700° C. to 1000° C. to grow the carbon nanotube array 20. The carbon source gas can be ethylene ($C_2H_4$), methane ($CH_4$), acetylene ($C_2H_2$), ethane ($C_2H_6$) or any combination thereof. Density, diameter and length of the carbon nanotube array 20 can be controlled by adjusting the flow rates of the carbon source gas, and by altering the temperature and reaction time.

Figure 3:
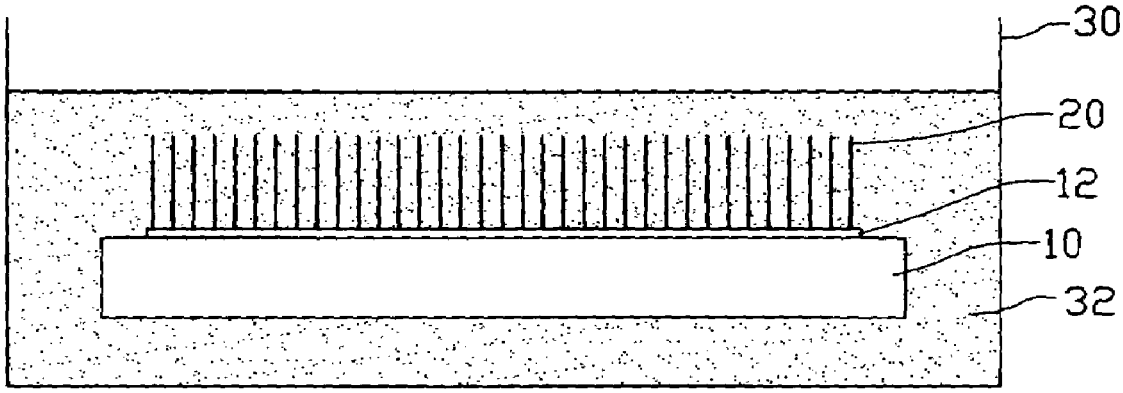
FIG. 3 is similar to FIG. 2, but showing the substrate with the carbon nanotube array thereon immersed in a liquid matrix.

Secondly, a matrix is provided, and the carbon nanotube array 20 is immersed into the matrix. Referring to FIG. 3, a liquid matrix 32 is injected into a container 30. The liquid matrix 32 can be a liquid phase-change material or other liquid polymer material; the phase-change material can be selected from the group consisting of paraffin, polyolefin, polyester, epoxy resin, acrylic acid, and other polymer materials. The preferred material of liquid matrix 32 is based on its melting point, the lower the better, so that the substrate 10 can more easily withstand the melting point temperature of the liquid matrix 32. The carbon nanotube array 20 with the substrate 10 should be immersed in the liquid matrix 32 until the carbon nanotube array 20 is completely saturated. The time of immersion is related to density, height and area of the carbon nanotube array 20. A viscosity of the liquid matrix 32 is required to be below 200 cPs (centipoises). In the preferred embodiment, the liquid matrix 32 is liquid paraffin.

Figure 4:
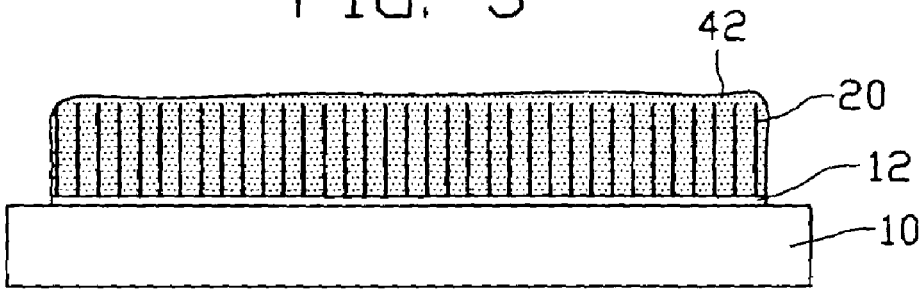
FIG. 4 is similar to FIG. 3, but showing the substrate withthe carbon nanotube array thereon embedded in the solidified matrix.
Figure 5:
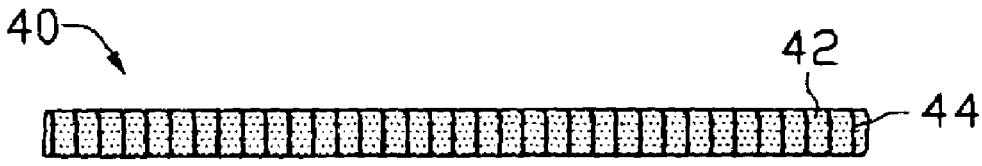
FIG. 5 is a schematic side view of a carbon nanotube array slice preform.

Thirdly, the liquid matrix 32 is cooled and solidified, a carbon nanotube array slice preform is manufactured by transversely slicing the carbon nanotube array. Referring to FIG. 4 and FIG. 5, the substrate 10 having the carbon nanotube array 20 immersed in the liquid matrix 32 is taken out of the container 30. Then, the matrix 32 is cooled and solidified. Otherwise, the liquid matrix 32 can be cooled and solidified first, and the substrate 10 having the carbon nanotube array 20 immersed in the liquid matrix 32 may then be taken out of the container 30. Then, transversely slicing the carbon nanotube array 20 using a slicer perpendicular to the axis of the carbon nanotube array 20 immersed in the solidified matrix 32 at a predetermined height for forming a preform of a carbon nanotube array slice 40 (see FIG. 5). The carbon nanotube array slice preform 40 includes carbon nanotube array slice 44 and matrix 42 for embedding the carbon nanotube array slice 44.

In addition, the carbon nanotube array 20 can be sliced after the carbon nanotube array 20 is separated from the substrate 10, thus forming carbon nanotube array slice preforms 40 having a predetermined height.

The method of manufacturing the carbon nanotube array slice preform 40 having predetermined height in the preferred embodiment including the steps of: transversely slicing the carbon nanotube array 20 perpendicular to the axis of the carbon nanotube array 20 immersed in the matrix 42, and removing excess matrix material on the carbon nanotube array 20. The carbon nanotube array slice preform 40 is sliced perpendicular to the axis of the carbon nanotube array 20, to give the carbon nanotube array slice preform 40 a predetermined height, where the predetermined height is in the range from 1 μm to 1000 μm. Therefore, most of the carbon nanotube segments of the carbon nanotube array slice preform 40 has two open ends, and the carbon nanotube segments are arranged uniformly and approximately parallel to each other.

Figure 6:
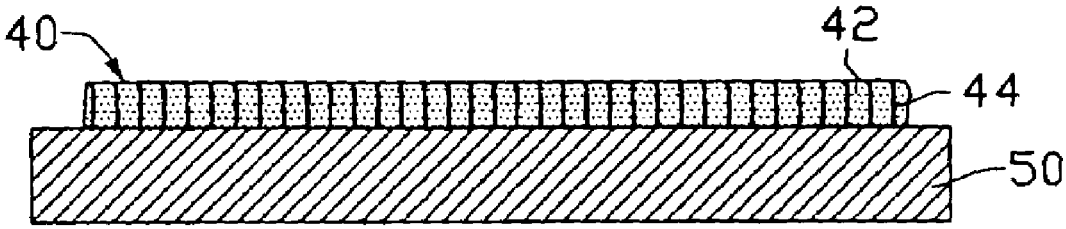
FIG. 6 is similar to FIG. 5, but showing the carbon nanotube array slice preform on the cathode substrate.

In step (2), referring to FIG. 6, the carbon nanotube array slice preform 40 is attached on a cathode substrate 50. The cathode substrate 50 can be made of silicon, ITO glass, a glass having dyestuff containing silver deposited thereon, a plastic plate having a conducting layer formed thereon, aluminum or other metals. In the preferred embodiment, the cathode substrate 50 is made of silicon.

In step (3), the cathode substrate 50 is heated until the matrix 42 becomes liquid. In step (4), the matrix 42 is removed to allow carbon nanotube array slice 60 to adhere to the cathode substrate 50. In the preferred embodiment, the matrix 42 is solidified paraffin that has its melting point in range from 50° C. to 70° C., so the cathode substrate 50 can be heated to about 80° C. The flexural ends of a plurality of the carbon nanotube array slice 44 will be stretched due to the rebound effect caused by cutting the carbon nanotube array slice 44 in the liquid paraffin. The paraffin can be removed using dimethyl benzene. Depending on the material used for the matrix 42 different organic solvents may be used, the organic solvent can remove the matrix 42, the organic solvent can be dimethyl benzene, toluene, isopropyl ethers chloroform etc. When the paraffin is removed, the carbon nanotube array slice 60 can be attached to the cathode substrate 50 by Van Der Waals forces; and the carbon nanotube array slice 60 can be electrically connected to the cathode substrate 50, so that a field emission device 100 may be obtained (see FIG. 7).

A field emission device according to a second preferred embodiment is provided. The second embodiment is similar to that of the first embodiment, except that the cathode substrate is a non-conducting plate having a silver-containing layer thereon. Correspondingly, in step (3) of the manufacturing method for the field emission device, the cathode substrate 50 and carbon nanotube array slice preform 40 thereon is heated in a nitrogen, argon or other shielding gas or vacuum environment up to a temperature in the range from 350° C. to 600° C., for a period of time in the range from 20 minutes to 60 minutes. The matrix (which in the preferred embodiment is paraffin) can thus be removed by vaporization of the matrix at a heating temperature due to the heating temperature being higher than melting point of the matrix. The carbon nanotube array slice can be adhered to the cathode substrate 50 by a strong binding force; the carbon nanotube array slice can be electrically connected to the cathode substrate, so that a field emission device can thus be obtained.

It is believed that the present embodiment and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A method for manufacturing a field emission device, comprising the steps of:

providing a carbon nanotube array slice preform, the carbon nanotube array slice preform comprising a matrix and a plurality of carbon nanotube segments incorporated in the matrix;

placing the carbon nanotube array slice preform on a cathode substrate;

heating the matrix so as to change the matrix into a liquid state;

removing the liquid state matrix after the matrix becomes liquid;

wherein the carbon nanotube array slice preform is made by a method comprising the steps of:

providing a carbon nanotube array;

immersing the carbon nanotube array into the matrix;

solidifying the matrix so as to cause the carbon nanotube array to be embedded in the matrix;

transversely slicing the carbon nanotube array thereby obtaining the carbon nanotube array slice preform.

2. The method of claim 1, wherein the matrix is removed using an organic solvent, and after the matrix is removed, the carbon nanotube segments are attached to the cathode substrate by Van Der Waals forces.

3. The method of claim 2, wherein the organic solvent is dimethyl benzene, toluene, isopropyl ether or chloroform.

4. The method of claim 1, wherein the matrix is heated by heating the cathode substrate.

5. The method of claim 1, wherein the matrix is a phase-change material.

6. The method of claim 5, wherein the phase-change material is selected from the group consisting of paraffin, polyolefin, polyester, epoxy resin and acrylate.

7. The method of claim 1, wherein the cathode substrate is heated in a shielding gas or vacuum environment.

8. The method of claim 7, wherein the cathode substrate is heated to a temperature in a range of about 350° C. to about 600° C.

* * * * *

UNITED STATES PATENT AND TRADEMARK OFFICE

CERTIFICATE OF CORRECTION

PATENT NO. : 7,608,293 B2
APPLICATION NO. : 11/453460
DATED : October 27, 2009
INVENTOR(S) : Huang et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 477 days.

Signed and Sealed this

Twelfth Day of October, 2010

David J. Kappos

David J. Kappos
*Director of the United States Patent and Trademark Office*